US009848716B2

(12) United States Patent
Obitts et al.

(10) Patent No.: US 9,848,716 B2
(45) Date of Patent: Dec. 26, 2017

(54) VENDING SHELF

(71) Applicant: Fasteners for Retail, Inc., Twinsburg, OH (US)

(72) Inventors: Shane Obitts, Elyria, OH (US); Gerald Matthew Szpak, Brecksville, OH (US); Christopher E. Bremenour, Chardon, OH (US)

(73) Assignee: FASTENERS FOR RETAIL, INC., Twinsburg, OH (US)

( * ) Notice: Subject to any disclaimer, the term of this patent is extended or adjusted under 35 U.S.C. 154(b) by 0 days.

(21) Appl. No.: 14/491,490

(22) Filed: Sep. 19, 2014

(65) Prior Publication Data

US 2015/0096997 A1 Apr. 9, 2015

Related U.S. Application Data

(60) Provisional application No. 61/888,184, filed on Oct. 8, 2013.

(51) Int. Cl.

| | |
|---|---|
| ***G07F 11/26*** | (2006.01) |
| ***A47F 3/02*** | (2006.01) |
| ***A47F 1/12*** | (2006.01) |
| ***A47F 3/00*** | (2006.01) |
| ***G07F 11/42*** | (2006.01) |

(52) U.S. Cl.

CPC ..... *A47F 3/02* (2013.01); *A47F 1/125* (2013.01); *A47F 3/002* (2013.01); *G07F 11/26* (2013.01); *G07F 11/42* (2013.01)

(58) Field of Classification Search

CPC ..... B65B 59/00
USPC ..... 221/227
See application file for complete search history.

(56) References Cited

U.S. PATENT DOCUMENTS

| | | | | |
|---|---|---|---|---|
| 2,784,871 | A | 3/1957 | Gabrielsen | |
| 2,937,650 | A * | 5/1960 | Buchholz | G07D 1/00 221/151 |
| 2,966,280 | A * | 12/1960 | Nelson | A63B 47/00 221/307 |
| 3,146,907 | A | 9/1964 | Bookout | |
| 3,262,603 | A | 7/1966 | Schendorf et al. | |
| 3,282,126 | A | 11/1966 | Dykinga et al. | |
| 3,730,409 | A | 5/1973 | Ratti | |
| 3,792,207 | A | 2/1974 | Muhling et al. | |

(Continued)

FOREIGN PATENT DOCUMENTS

GB 2 386 116 A 9/2003

OTHER PUBLICATIONS

FFR-DSI Total Retail Solutions 2013 Yellow Pages Product Catalog, cover page and p. 338.

*Primary Examiner* — Timothy Waggoner
*Assistant Examiner* — Ayodeji Ojofeitimi
(74) *Attorney, Agent, or Firm* — Honigman Miller Schwartz and Cohn LLP

(57) ABSTRACT

A merchandise dispensing apparatus for deterring theft includes a housing having a plurality of walls defining an interior space within the housing. At least one merchandise support module is mounted in the housing and includes an electro-mechanical ejector located adjacent a front end of the at least one module. The ejector includes an electrical motor with an output shaft, along with an ejector plate movably mounted in relation to the housing. A gear train connects the output shaft of the motor to the ejector plate. A relay selectively provides electrical power to the motor.

10 Claims, 12 Drawing Sheets

(56) References Cited

U.S. PATENT DOCUMENTS 4,363,393 A 12/1982 McDonald
4,711,369 A 12/1987 Duchin
4,887,737 A 12/1989 Adenau
5,133,478 A * 7/1992 Gordon ..... A61J 7/0409 221/69
5,191,995 A * 3/1993 McDonald ..... A63B 47/002 221/227
5,238,144 A 8/1993 Kornegay
5,301,834 A * 4/1994 Lee ..... B65H 3/523 221/129
5,605,249 A 2/1997 Gonyea
5,665,304 A 9/1997 Heinen et al.
5,782,377 A * 7/1998 Fassman ..... B65G 59/067 221/115
5,857,588 A 1/1999 Kasper
6,247,611 B1 6/2001 Clements et al.
6,264,060 B1 7/2001 Podgorny et al.
6,478,187 B2 * 11/2002 Simson ..... G06Q 30/06 221/129
6,604,652 B1 * 8/2003 Trautwein ..... G07F 11/42 221/124
6,811,053 B2 11/2004 Schwarzli
7,828,158 B2 * 11/2010 Colelli ..... G07F 9/02 211/59.3
8,413,843 B2 * 4/2013 Vardaro ..... B65D 83/0418 221/125
8,662,320 B2 * 3/2014 Csak ..... A47F 5/0087 211/59.3
2004/0060944 A1 4/2004 Gervasi
2005/0189369 A1 * 9/2005 Vlastakis ..... A47F 1/126 221/123
2006/0180603 A1 8/2006 Eckert
2011/0130782 A1 * 6/2011 Kan ..... A61B 5/1411 606/182
2012/0055892 A1 3/2012 Hardy
2012/0067917 A1 3/2012 Obitts et al.
2014/0034592 A1 2/2014 Hardy
2014/0117818 A1 5/2014 Dipaolo et al.
2014/0190913 A1 7/2014 Hardy et al.

* cited by examiner

FIG. 2
(PRIOR ART)
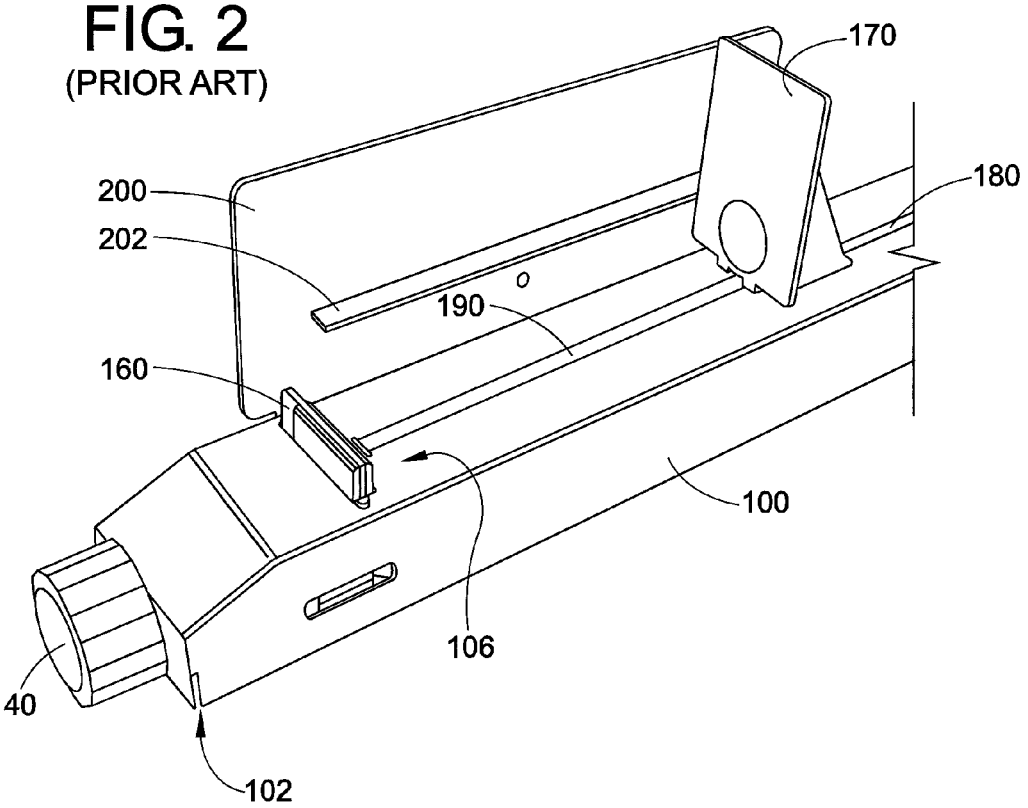
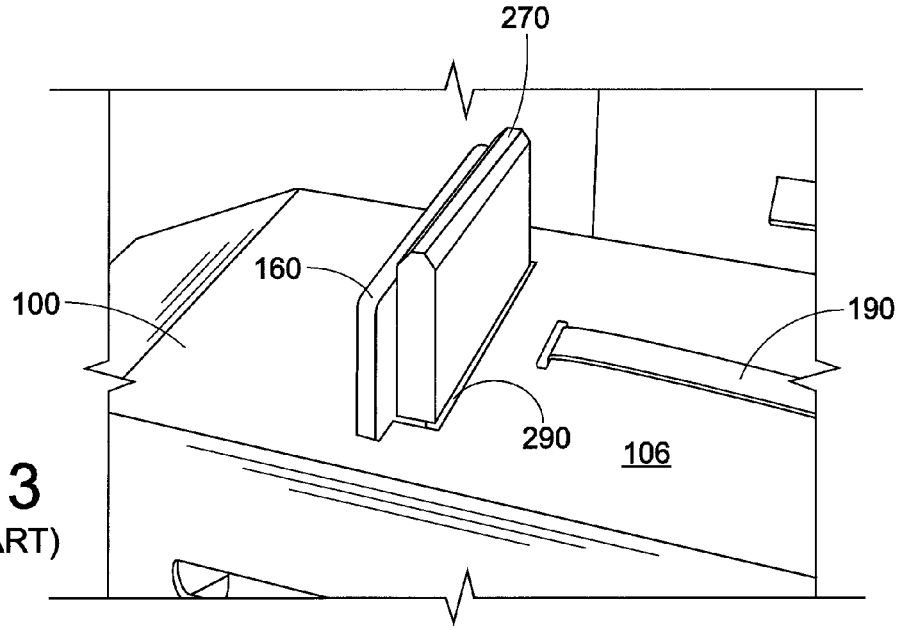
FIG. 3
(PRIOR ART)

VENDING SHELF

BACKGROUND

The present exemplary embodiment relates generally to theft deterrence. It finds particular application in conjunction with dispensing merchandise in retail stores, and will be described with particular reference thereto. However, it is to be appreciated that the present exemplary embodiment is also amenable to other like applications.

Product dispensing machines (i.e., vending machines) are typically designed for storing products of all kinds and for dispensing such products to consumers in exchange for currency without vendor attention. Vending machines are essentially vaults which store inserted currency and products for sale. As such they are expensive to provide and to operate and are not easy to use for all types of products.

More recently, retail stores that traditionally display products on open shelves have experienced product theft by "sweeping," a technique used by thieves wherein products for sale that are displayed on open shelves are swept, using an arm motion moving over the shelf to push a large quantity of product into waiting bags. Often these products do not have significant resale value individually, but will provide income to the thief upon resale of numerous products in a gray or black market. Such products can include razors or ink cartridges that have appreciable resale value. Infant formula is another example of such merchandise.

A new generation of merchandise dispensing machines has been developed to specifically deal with the theft of items which are displayed on open shelves. Such a machine dispenses products in a similar manner as a coin operated vending machine, but without the need for the consumer to place currency in the machine to operate it. Its primary purpose is to thwart theft or at least retard repeated access to merchandise held in an enclosure.

The present application discloses a new and improved system and method which, among other things, deters theft and retards product or merchandise sweeping.

BRIEF DESCRIPTION

In accordance with one aspect of the present exemplary embodiment, a dispenser is provided for deterring the theft of packaged items. The dispenser includes an electro-mechanical ejector, as well as a controller disabling the electro-mechanical ejector when lockout criteria are present. Such lockout criteria can include a packaged item having been dispensed within a predetermined time period. The controller can further generate an audio and/or visual alert in response to a vending or merchandising of a predetermined number of packaged items within a predetermined amount of time.

In accordance with a second present exemplary embodiment, a merchandise dispensing apparatus for deterring theft is provided. The apparatus comprises a housing including a plurality of walls defining an interior space within the housing. Mounted in the housing is at least one merchandise support module which includes an electro-mechanical ejector. The ejector further includes an electrical motor with an output shaft, an ejector plate movably mounted in relation to the housing, a gear train connecting the output shaft of the motor to the ejector plate, a relay for selectively providing electrical power to the motor, and a user input member for selectively operating the motor via the relay.

In accordance with a third present exemplary embodiment, a merchandise dispensing apparatus for deterring theft is provided. The apparatus comprises a housing including a plurality of walls defining an interior space within the housing. Mounted in the housing are at least two spaced merchandise support modules, each module including an electro-mechanical ejector. The apparatus further comprises at least two user input members accessible from outside the housing, each of the at least two members electrically communicating with the respective ejector of the at least two modules. Apparatus further includes a controller electrically communicating with the at least two user-input members and each of the ejectors. The controller includes a memory and a processor.

In accordance with a second aspect of the present exemplary embodiment, a method of dispensing merchandise to deter theft is provided. The method comprises providing a merchandise dispensing apparatus comprising a housing accommodating at least two spaced merchandise support modules, each including an ejector and a user input member. The method further comprises providing a controller connected to each the ejector and the user input member of the at least two modules. The method also includes monitoring via the controller a triggering occurrence from a respective one of the user-input members and determining via the controller whether a lockout is in place. If the controller determines there a lockout, the method provides that the controller return to monitoring a triggering occurrence of the user-input members. The method additionally comprises determining whether to dispense one of a plurality of packaged items using the ejector corresponding to the triggered user-input member. The method finally comprises notifying other merchandise support modules of the dispensing of the one of the plurality of packaged items.

BRIEF DESCRIPTION OF THE DRAWINGS

FIG. 2 is an enlarged perspective view of a module of the dispenser of FIG. 1;

FIG. 3 is an enlarged perspective view of a portion of the module of FIG. 2 in which an ejector plate is shown in a raised position;

DETAILED DESCRIPTION

Figure 1:
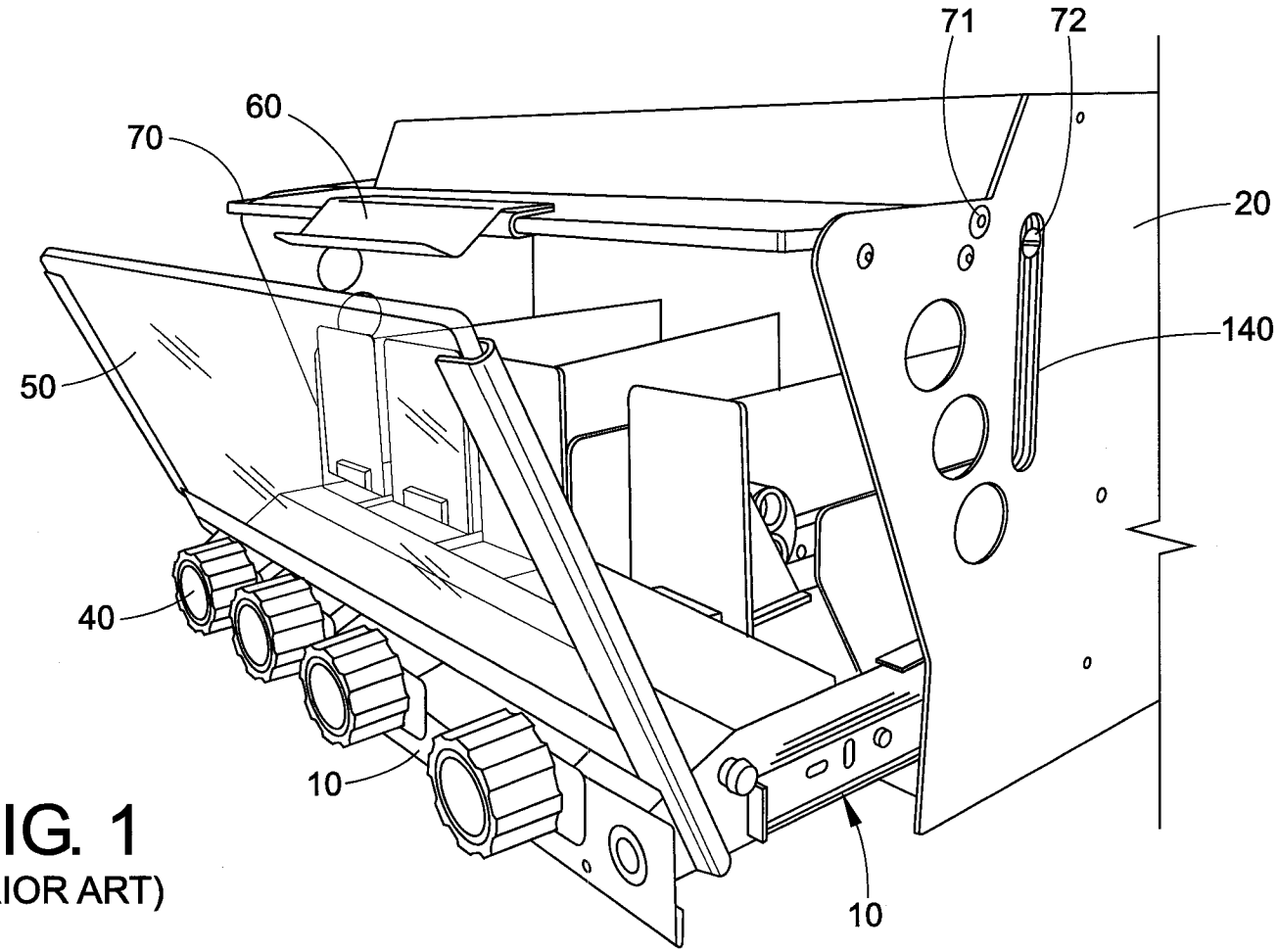
FIG. 1 (PRIOR ART)
FIG. 1 is a perspective view of a known dispenser.

With reference to FIG. 1, a perspective view of a dispenser according to U.S. Pat. No. 7,828,158, filed Sep. 1, 2007, to Colelli et al. is provided. This patent is incorporated herein by reference in its entirety. The dispenser is suitably employed in a commercial setting, such as a retail store, to dispense packaged items. However, it is to be understood that it can be employed to dispense other types of packaged items. The dispenser has a box structure (only part of which is visible) having a plurality of walls enclosing and defining an interior space. The walls prevent access to the interior space from at least the front, the sides, the top and the bottom.

The dispenser includes a storage shelf 10 mounted in a wrap-around enclosure 20. The enclosure 20 can be a sheet metal box open on its front and rear, but closed on its sides and top. The shelf 10 can close the bottom of the enclosure 20. The enclosure 20 may be mounted on wall standards as shown in U.S. Pat. No. 7,419,062, filed Jan. 18, 2006, to Mason, incorporated herein by reference in its entirety. This advantageously prevents access to the interior space from the rear. Alternately, the dispenser may be placed on a shelf or otherwise secured within a retail establishment in a manner that restricts access to the rear and which prevents unauthorized persons from moving the dispenser. For example, the dispenser may be bolted in place.

In use, the shelf 10 is locked within the enclosure 20 so that packaged items mounted within the dispenser are only accessible via a controlled dispensing process. A packaged item can be dispensed by turning a knob 40, which dispenses a corresponding packaged item to a forward position on the shelf 10 lying against a front glass plate 50. A flat handle 60 is then raised, thereby lifting a top glass plate 70 from a closed orientation or position into an open position. The top glass plate 70 is mounted via a first hinge 71. When the flat handle 60 and the top glass plate 70 are open, a person's hand is able to reach into the dispenser from above to retrieve the dispensed merchandise.

Simultaneous with lifting the top glass plate 70, a barrier strip (not shown) can be lowered, which may have a message printed on it, such as "Stop Theft At Retail." The barrier strip, engaged with the plate 70 by a second hinge, assumes a vertical position blocking access to all but the frontal portion of the interior space accommodating the dispensed packaged item. Therefore, the barrier strip only allows access to the dispensed packaged item and provides a means of theft deterrence.

The top glass plate 70 pivots on hinges secured by fasteners 71 on opposing sides of the enclosure 20. Also, on each side of the enclosure 20 are vertical slots 140 within which ride screws 72 that control the attitude of the barrier strip. The barrier strip is hinged via a piano hinge to the top glass plate 70, so that when the top glass plate 70 is raised, the barrier strip is rotated into the vertical position and the screws 72 are at the bottom of the slots 140. Similarly, when the top glass plate 70 is lowered it forces the barrier strip into a horizontal position where the screws 72 are at the top of the slots 140.

With reference to FIGS. 2 and 3, a module 100 of the dispenser in its upright attitude is illustrated. A forward module slot 102 at the knob end of the module 100 engages a forward shelf slot thereby holding the module 100 in position on the shelf 10. The module 100 further includes a rear module slot which engages a rear shelf slot. Therefore the module 100 is secured and immovable on the shelf 10 from left to right and also front to back.

A top surface 106 of the module 100 has a longitudinal slot 180 which runs over a majority of the length of the module 100. Mounted in the slot 180 is a compression trolley 170, which is engaged with slot 180 via a wider portion at the rear end of the module 100. The trolley 170 carries a clock spring 190, which is secured in a spring slot 180. When the trolley 170 is pressed toward the rear of the module 100, the clock spring 190 unreels and is wound tighter as a portion of the spring 190 reels out. This provides a force for biasing or urging packaged items toward the knob end or the front end of the module 100.

One or more packaged items may be rested on the top surface 106 and compressed between the trolley 170 and a fixed stop plate 160, which is secured at a forward position on the module 100 and which protrudes above surface 106. A side wall 200 at one side of the module 100 can carry a flange 202 extending from both sides of the side wall 200. The flange 202 is essentially at the level of the top surface 106 so that, with packaged items sitting on the surface 106 and abutting the side wall 200 of the flange 202, the packaged items also rest on the flange 202. In some embodiments, packaged items can rest on the flange 202, as well as the flange of an adjacent module 100, to be raised slightly above the surface 106 so as not to interfere with the spring 190.

The side wall 200 includes three slots which are formed on a bottom plate of the side wall 200, the bottom plate integrally formed with the sidewall 200. Three studs grip the bottom plate while allowing it to move over a linear excursion limited by the length of the slots so that the side wall 200 is able to be positioned laterally to accommodate packaged items of various widths.

In setting up the modules 100 in the shelf 10, an appropriately sized module 100 is selected for each type of packaged item to be included on the shelf 10. Further, each side wall 200 is adjusted laterally so as to contact one side of its respective packaged items when the packaged items are laterally centered on the surface 106 of its respective module 100. Working from left to right on the shelf 10, the adjusted modules 100 are placed on the shelf 10 and engaged with the shelf slots, with the side wall 200 of each next module 100 positioned against the packaged items of the module 100 to its right. In this manner, each line of packaged items will have a side wall 200 on both of its opposite vertical sides, forming a guide way so that when a packaged item is dispensed the remaining packaged items are guided as they are pressed forward by trolley 170.

Each module 100 further includes an ejector so that packaged items on each of the modules 100 may be dispensed independently of the other modules 100. To dispense the first packaged item of a module 100 (i.e., the packaged item that is in the most forward position on the module 100 and so rests against the stop plate 160 prior to being dispensed), the knob 40 is rotated.

As the knob 40 is rotated, a shaft which is joined to, and extends rearward from, the knob 40, causes a crank to move a movable ejector plate 270 in a slot 290. The ejector plate 270 is caused to slide linearly upwardly toward the surface 106. The ejector plate 270 then moves through the slot 290 in the surface 106 of the module 100 and protrudes at its highest above the fixed stop 160 so that the first packaged item, which is resting against the fixed stop 160, is pushed above the fixed stop 160. When this happens, the spring tension that is delivered to the first packaged item by the trolley 170 through any intervening packaged items, delivers an ejecting force to the lifted first packaged item causing it to move forward in the dispenser coming to rest against front glass plate 50, where it is ready to be manually removed through the open top glass plate 70.

The rotation of the knob 40 continues so that the ejector plate 270 moves at once down through the slot 290 into a position below the surface 106, thereby completing one ejection cycle. With the first packaged item and also the ejector plate 270 no longer present, the next packaged item in line is forced to move up against the fixed stop 160 and is therefore in position to be ejected whenever the knob 40 is next rotated.

The foregoing pertains to a dispenser according to U.S. Pat. No. 7,828,158, filed Sep. 1, 2007, to Colelli et al., and incorporated herein by reference in its entirety. The present application discloses a dispenser improving on the design of Colelli. In contrast with the mechanical ejector of Colelli, the dispenser of the present application employs an electro-mechanical ejector. Further, in contrast with Colelli, the dispenser of the present disclosure can disable movement of a vending mechanism of the dispenser if certain lockout criteria are met. The dispenser can further generate an audio and/or visual indication in response to the dispensing of a packaged item.

Figure 4:
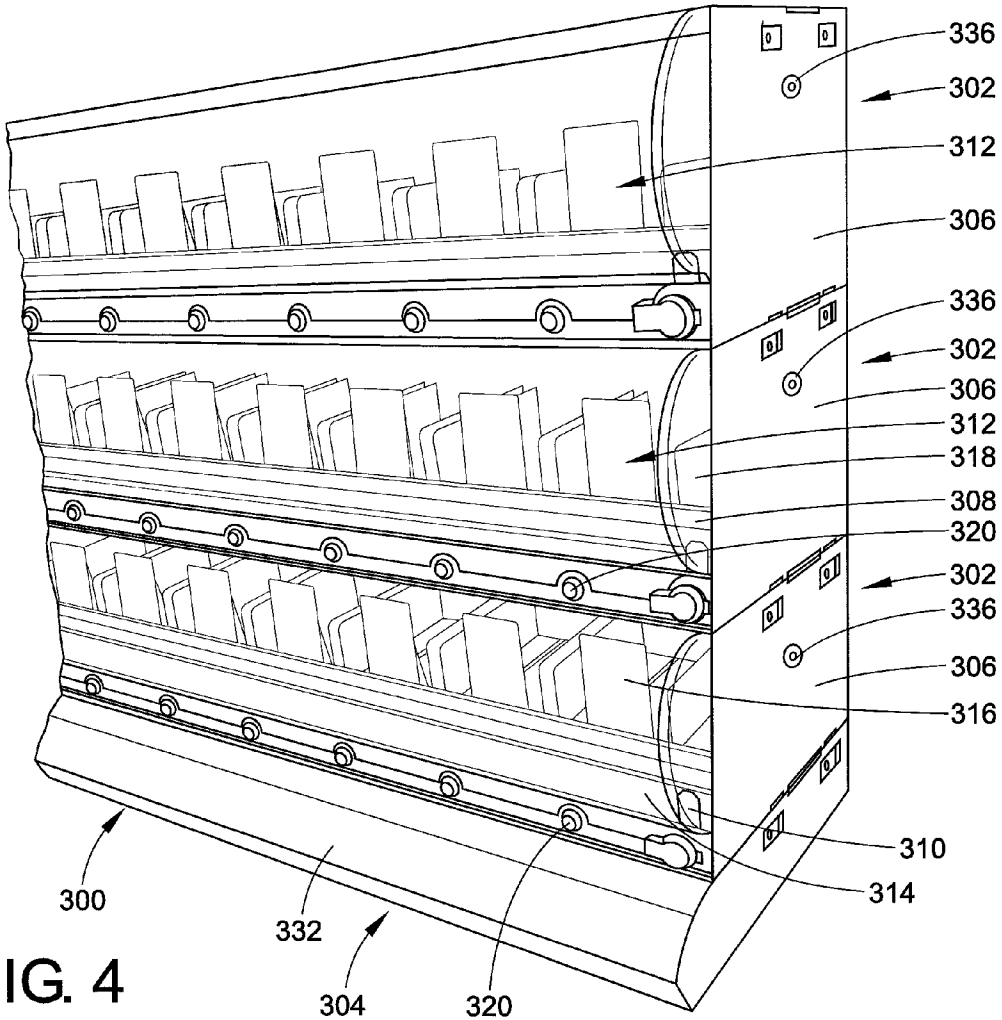
FIG. 4 is a perspective view of a dispenser system according to the present disclosure, the dispenser system including a plurality of dispensers vertically stacked upon each other.

With reference to FIG. 4, a dispenser system 300 includes one or more dispensers 302 stacked vertically upon a base 304. The dispensers 302 dispense packaged items, such as packaged merchandise, and each can hold a plurality of packaged items. As illustrated, the dispenser system 300 includes three dispensers 302 stacked vertically upon the base 304. The dispensers 302 are secured to one another and the base 304 in a manner that prohibits a would-be thief from simply removing the dispensers 302 from the stack. For example, the dispensers 302 can be screwed or bolted together.

While not necessary, the base 304 can include electronics for providing power to the dispensers 302. For example, the base 304 can include electronics converting alternating current (AC) from an external power source, such as a power grid, to direct current (DC). As another example, the base can house batteries to power the dispensers 302. The base 304 can further include a central controller coordinating the vending or merchandising of the packaged items from the dispenser system 300.

The dispensers 302 each include an enclosure 306, such as sheet metal box, and a storage shelf 308 mounted within the enclosure 306. The enclosure 306 surrounds the storage shelf 308 on all sides and further includes a front opening covered by a transparent window 310 of the dispenser 302. The transparent window 310 allows packaged items loaded on the storage shelf 308 to be externally viewed. In use, the shelf 308 is locked within the enclosure 306 so that packaged items loaded in the dispenser 302 are only accessible via a controlled dispensing process. The specific approach to loading the storage shelf 308 with packaged items is not important. However, in some embodiments, loading is accomplished by removing the transparent window 310 to obtain access to the shelf 308. The shelf 308 is then loaded through the front opening. Once loaded with packaged items, the transparent window 310 is secured over the front opening.

The shelf 308 includes a plurality of tracks 312 for dispensing packaged items. Each track 312 accommodates a plurality of packaged items arranged single file or in a column between a fixed stop plate 314 and a compression trolley or pusher 316. The compression trolley 316 presses the packaged items to the fixed stop plate 314. The specific approach by which the compression trolley 316 applies pressure to the packaged items can vary, but in some embodiments, the compression trolley 316 carries a coil spring secured proximate to the fixed stop plate 314. When the trolley 316 is pressed toward the rear of the track 312, the coil spring unreels and is wound tighter as a portion of the spring reels out. This provides force for pressing or urging packaged items toward the front of the track 312.

To ensure that the packaged items on a track 312 maintain a single filed ordering or columnar form between the fixed stop plate 314 and the compression trolley 316, each track 312 includes one or more side walls 318 abutting the packaged items. Typically, a track 312 includes sidewalls 318 on both sides of the packaged items. However, in some embodiments, a track 312 includes a sidewall 318 on only one side of the packaged items. The sidewall 318 of an adjacent track 312 is then used to define the other side of the track 312.

The shelf 308 further includes a user input device or member 320, such as the illustrated push button, mounted to the front wall or face of the dispenser 302 for each of the plurality of tracks 312. When a user input device 320 is triggered, a packaged item is dispensed from the corresponding track 312 so long as a lockout of a predetermined period of time, such as 7-10 seconds, is not underway. A lockout for a track 312 can occur, for example, in response to vending or merchandising of a packaged item by one of: 1) the track 312; 2) any track 312 of the corresponding dispenser 302; and 3) any track 312 of the dispenser system 302. As another example, a lockout for a track 312 can occur in response to vending or merchandising a predetermined number of packaged items, such as three, within a predetermined period of time, such as 30 seconds. This vending or merchandising can be limited to the track 312, the tracks 312 of the corresponding dispenser 302, any track 312 of the dispensers system 300, or any track 312 of any dispenser system 300.

Figure 5:
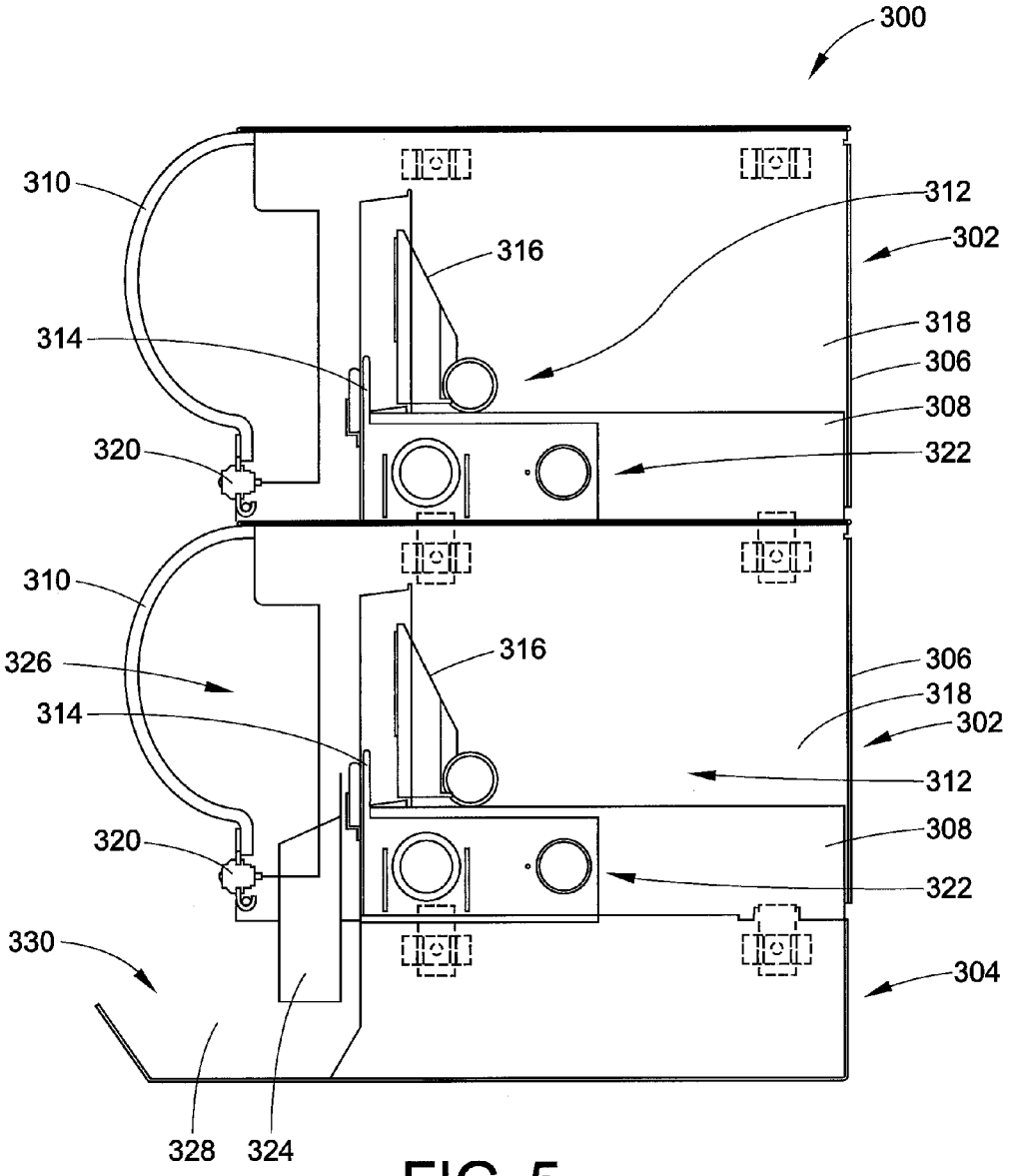
FIG. 5 is a partial, cross-sectional view of the dispenser system according to FIG. 4 in which only two of the dispensers are shown and in which a packaged item is being vended or merchandised.

With reference to FIG. 5, a partial, cross-sectional view of the dispenser system 300 of FIG. 4. In contrast with FIG. 4, only two of three or more dispensers 302 are illustrated. To carry out vending or merchandising, each track 312 includes an ejector 322. During vending or merchandising, the ejector 322 coordinates with the compression trolley 316 of the track 312 to move the first packaged item 324 of the track 312 (i.e., the front most packaged item abutting the fixed stop plate 314) to a forward channel 326 extending vertically through all the dispensers 302 to an externally accessible cavity 328 of the base 304. It should be appreciated that the forward channel 326 is located in front of each dispenser 302 and the channels 326 are aligned so that merchandise or packaged items 324 can fall by gravity to the base 304. When the first packaged item 324 reaches the forward channel 326, the packaged item 324 falls through the forward channel 326 to the cavity 328, as illustrated. The forward channel 326 is defined by openings in the top and bottoms of each dispenser 302 which are sized to accommodate the packaged items. The cavity 328 is typically externally accessible via an opening 330 in the base 304. While not necessary, a hinged door 332 of the base 304 can cover the opening 330, as illustrated in FIG. 4. The hinged door 332 can be pivotally mounted and would be lifted to allow access to the cavity 328.

Figure 6:
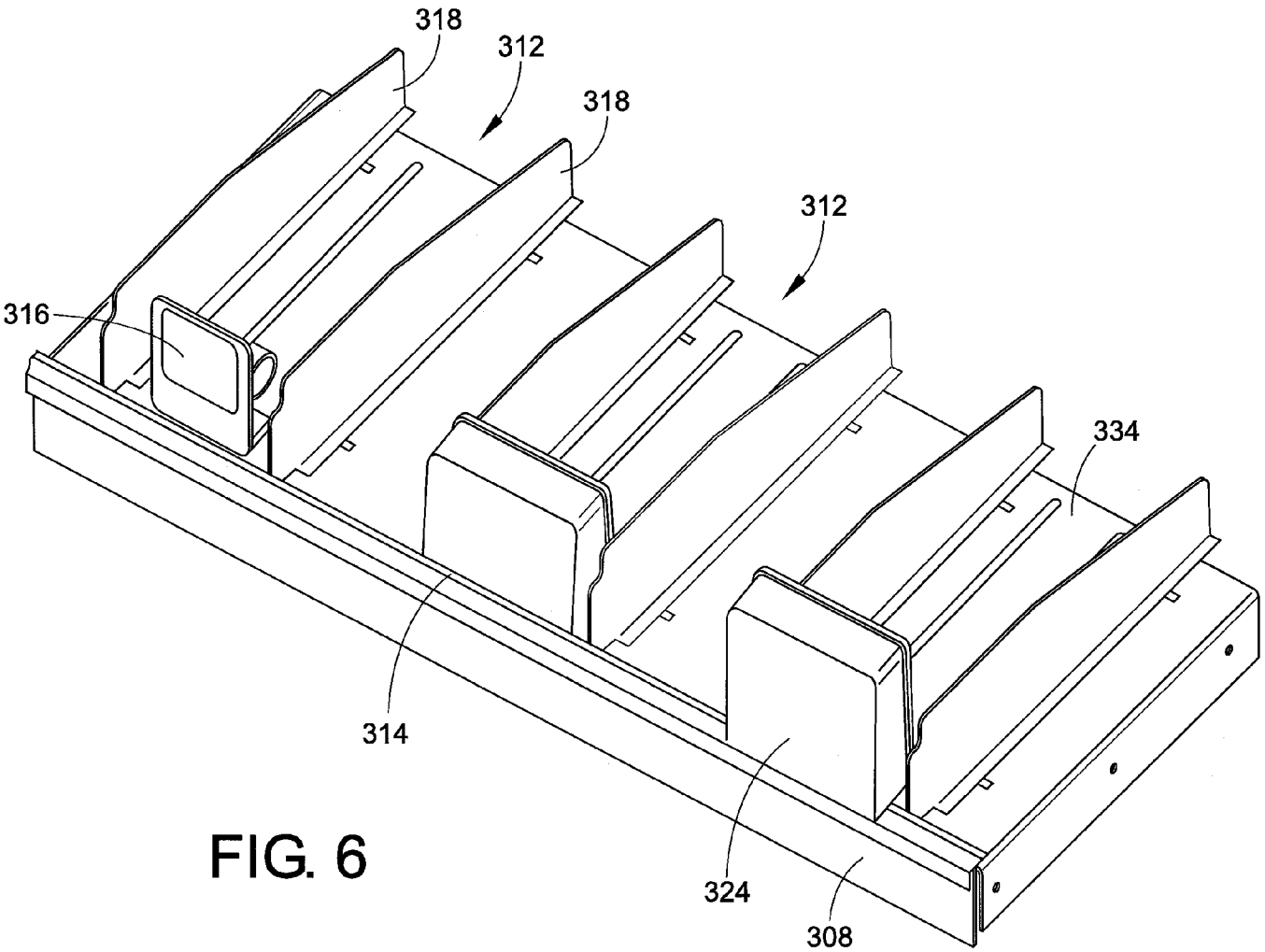
FIG. 6 is an enlarged partial, perspective view of a shelf of a dispenser of FIG. 4 in which only three tracks are shown and in which the packaged item of FIG. 5 is being vended or merchandised.

With reference to FIG. 6, the vending or merchandising of the first packaged item 324 is illustrated in greater detail. During vending or merchandising of the packaged item 324, the ejector 322 moves an ejector plate linearly upwardly toward the surface 334 of the track 312 upon which the packaged item 324 rests. The ejector plate then moves through a slot in the surface 334 of the track 312 to its highest position such that a portion of the plate is located above the fixed stop plate 314. The slot is located adjacent to the fixed stop plate 314 and immediately beneath the packaged item 324 so that the first packaged item 324 is pushed above the fixed stop plate 314. When this happens, the force that is delivered to the first packaged item 324 by the trolley 316 through any intervening packaged items, delivers an ejecting force to the lifted first packaged item 324 causing it to move forward in the dispenser 302, as illustrated. The item 324 then falls through the forward channel 326. After reaching its highest position above the fixed stop plate 314, the ejector plate moves at once downwardly through the slot and to a position below the surface 334, thereby completing one ejection cycle. With the first packaged item 324 and also the ejector plate are no longer present, the next packaged item in line is forced to move up against the fixed stop plate 314 and is therefore in position to be ejected next.

Figure 7:
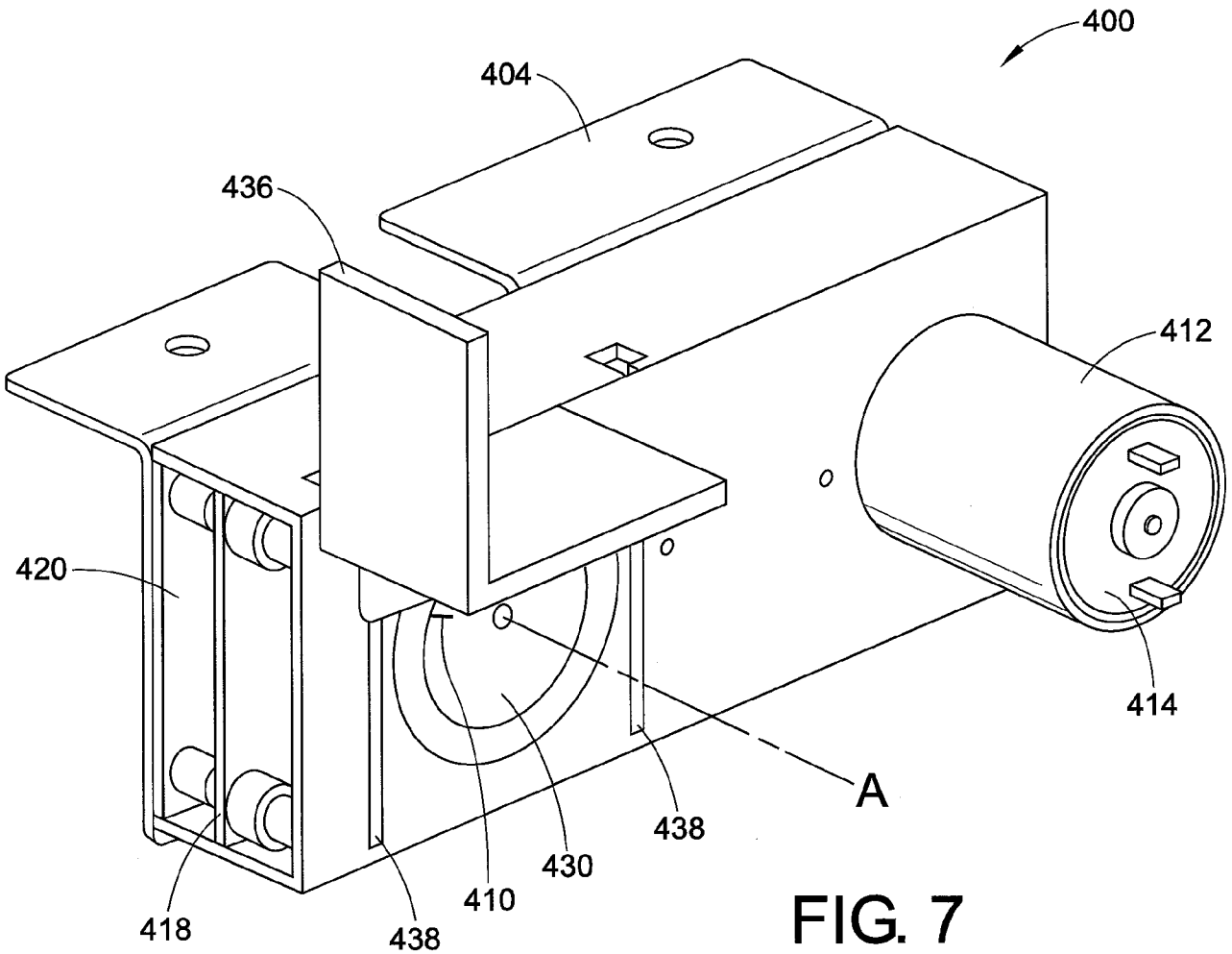
FIG. 7 is a perspective view of an electro-mechanical ejector according to aspects of the present disclosure.
Figure 8:
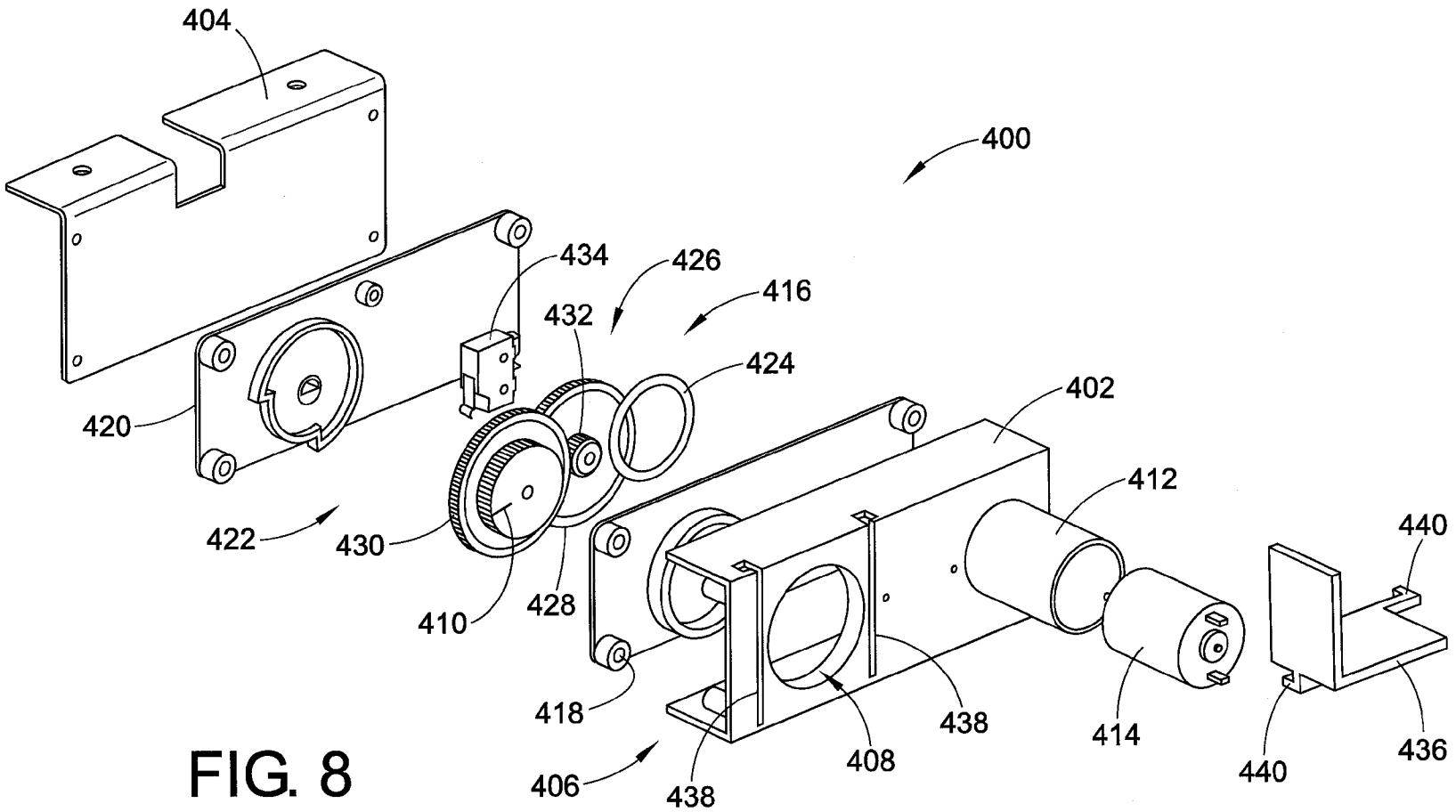
FIG. 8 is an exploded, perspective view of the electro-mechanical ejector of FIG. 7.

With reference to FIGS. 7 and 8, an electro-mechanical ejector 400 that can be used herein is provided. FIG. 7 illustrates a perspective, exploded view of the ejector 400, and FIG. 8 illustrates an exploded view of the ejector 400. This ejector 400 can also be used in other dispenser systems, such as U.S. Pat. No. 7,828,158, filed Sep. 1, 2007, to Colelli et al., which is incorporated herein by reference in its entirety.

The ejector 400 includes a front housing 402 mating with a back housing 404 to define an enclosed, interior region 406. The front housing 402 includes an aperture 408 sized to allow a pin 410 rotating at a predetermined distance around a central axis A to extend from the interior region 406 through the aperture 408. The front housing 402 can further include a generally cylindrical compartment or housing 412 for accommodating a motor, such as a DC motor 414. The motor 414 drives a set of gears 416 within the interior region 406 that drive the pin 410 around the central axis A. The set of gears 416 suitably reduce the rotary speed of the motor 414 to increase torque.

To mount the set of gears within the interior region 406, the ejector 400 includes a cover plate 418 and a base plate 420 mounting to the front and back housings 402, 404. The cover plate 418 and the base plate 420 further mate to define an interior region 422 for the set of gears 416. As illustrated, a first gear 424 of the set 416 is connected to a rotating shaft (not visible) of the motor 414, which extends through the cover plate 418. The first gear 424 transfers its rotary motion to a second gear 426 of the set 416 by way of a first tooted region 428 of the second gear 426 having a greater diameter than the first gear 424. The second gear 426 transfers its rotary motion to a third gear 430 of the set 416 by way of a second toothed region 432 of the second gear 426 having a smaller diameter than the first gear 424. Such gears are sometimes termed compound gears. The pin 410 described above mounts to the third gear 430 and rotates the predetermined distance about the central axis A of the third gear 430.

Also located within the interior region 422 of the cover plate 418 and the base plate 420 is an electrically controlled relay 434 for providing power to the motor 414 with a power source external to the ejector 400, such as batteries or a power grid. Further, the relay 434 is controlled, as described below, by a controller. For each ejection cycle, the controller engages the relay 434, and hence the motor 414, for a predetermined period of time known to correspond to one full ejection cycle.

Mounted to the exterior of the front housing 402, the ejector 400 includes an ejector plate 436 moving up and down along two slots 438 positioned vertically on opposite sides of the aperture 408. The ejector plate 436 includes an attachment feature 440 which mounts within the slots 438. As illustrated, the ejector plate 436 can include L-shaped fingers 440 which fit within the slots 438 for mounting. To move the ejector plate 436 up and down, the ejector plate 436 rests upon the pin 410 extending through the aperture 408. As the pin 410 rotates upward, the ejector plate 436 moves upward along the slots 438. Similarly, as the pin 410 rotates downward, the ejector plate 436 moves downward along the slots 438.

Referring back to the dispensing system 300 of FIG. 5, ejector 400 as illustrated in FIGS. 7-8 can be used in place of ejector 322. To carry out vending or merchandising, each track 312 then includes an ejector 400. During vending or merchandising, the ejector 400 coordinates with the compression trolley or pusher 316 of the track 312 to move the first packaged item 324 located on the track 312 (i.e., the front most packaged item abutting the fixed stop plate 314) over the stop plate 314 and into a forward channel 326 extending vertically through all the dispensers 302 to an externally accessible cavity 328 located in the base 304. It should be appreciated that the forward channel 326 is located in front of each dispenser 302 and the channels 326 are aligned so that merchandise or packaged items 324 can fall by gravity to the base 304. When the first packaged item 324 reaches the forward channel 326, the item falls through the forward channel to the cavity 328, as illustrated. The forward channel 326 is defined by openings in the top and bottoms of each dispenser 302 which are sized to accommodate the items being dispensed. The cavity 328 is typically externally accessible via an opening 330 in the base 304. While not necessary, a hinged door 332 of the base 304 can cover the opening 330, as illustrated in FIG. 4. The hinged door 332 can be pivotally mounted and would be lifted to allow access to the cavity 328.

Referring back to the dispensing system 300 of FIG. 6, the vending or merchandising of the first item or product 324 is illustrated in greater detail. Ejector 400 as illustrated in FIGS. 7-8 can be used in place of ejector 322. During vending or merchandising of the item 324, the ejector 400 moves an ejector plate 436 linearly upwardly above the surface 334 of the track 312 upon which the packaged item 324 rests. The ejector plate moves upward along two slots 438 positioned vertically on opposite sides of the aperture 408. The ejector plate 436 includes an attachment feature or L-shaped fingers 440 which mount within the slots 438 and permit the ejector plate 436 to move linearly upward and downward with respect to the front housing 420. Pin 410 is mounted to the third gear 430 in the compound gear train 416 and engages the ejector plate 436.

As the third gear 430 rotates, the pin 410 causes the ejector plate 436 to move upward through a slot in the surface 334 of the track 312 to its highest position such that a portion of the ejector plate 436 is located above the fixed stop plate, sometimes termed front rail, 314. The slot is located adjacent to the fixed stop plate 314 and immediately beneath the item 324 so that the forward-most item 324 is pushed above the stop plate from the ejecting force created by the ejector plate 436 acting on the bottom surface of the item. When this happens, the force that is delivered to the forward-most item 324 by the trolley or pusher 316 through any intervening packaged items, urges the forward-most item in a forward direction in the dispenser 302, as illustrated. The item 324 then falls through the channel 326.

After reaching its highest position above the fixed stop plate 314, the ejector plate 436 moves at once downwardly through the slot as the third gear 430 continues to rotate until pin 410 lowers ejector plate 436 in a position below the surface 334, thereby completing one ejection cycle. Quite simply, the rotational motion of the motor output shaft is translated into linear motion of the ejector plate 436. The compound gears 424, 426 and 428 serve to decrease the speed of motion. With the forward-most packaged item 324 and the ejector plate 436 no longer present, the next packaged item in line is urged to move up against the fixed stop plate 314 and is therefore in position to be ejected next.

Figure 9:
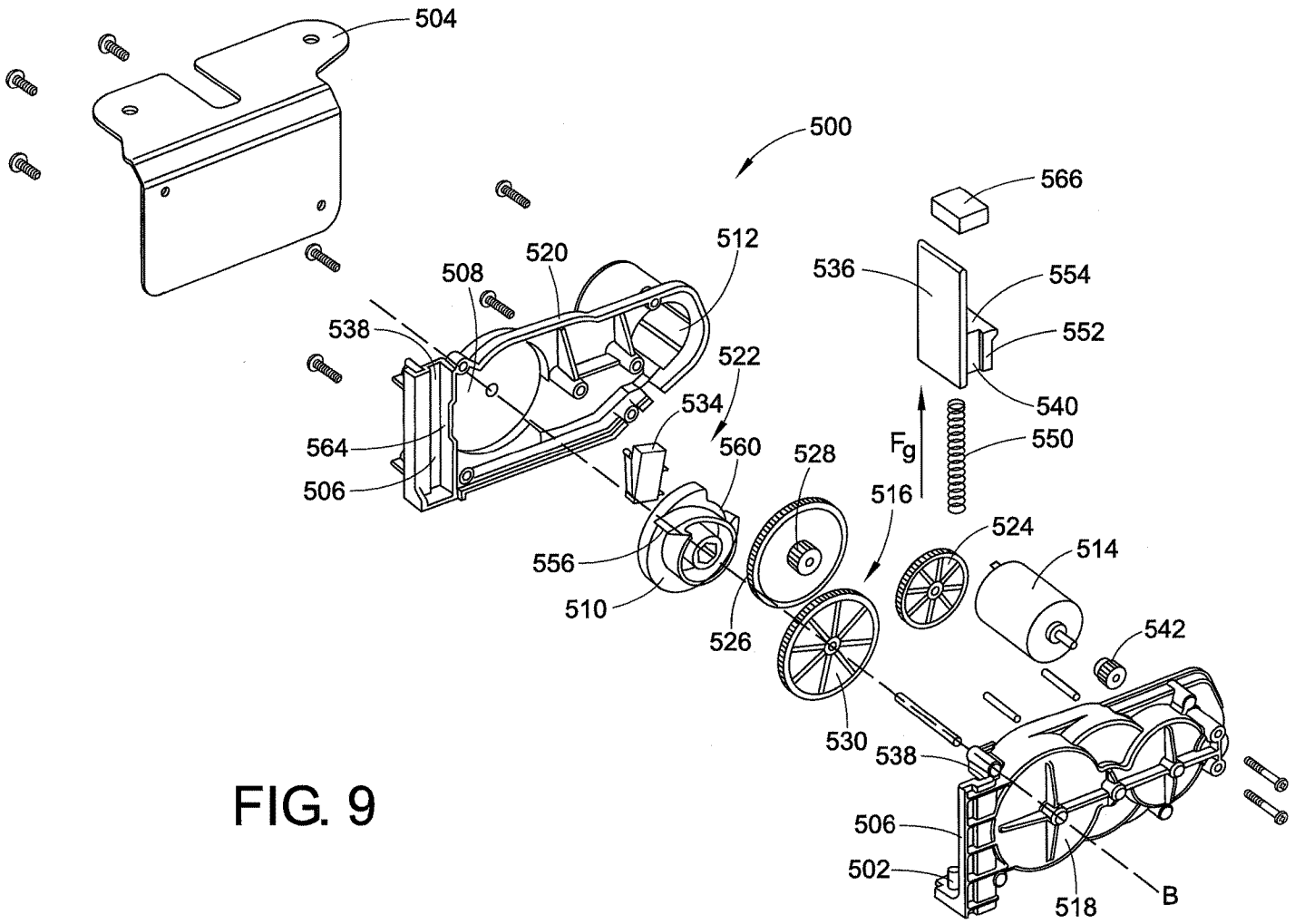
FIG. 9 is an exploded, perspective view an electro-mechanical ejector according to aspects of the present disclosure.
Figure 10:
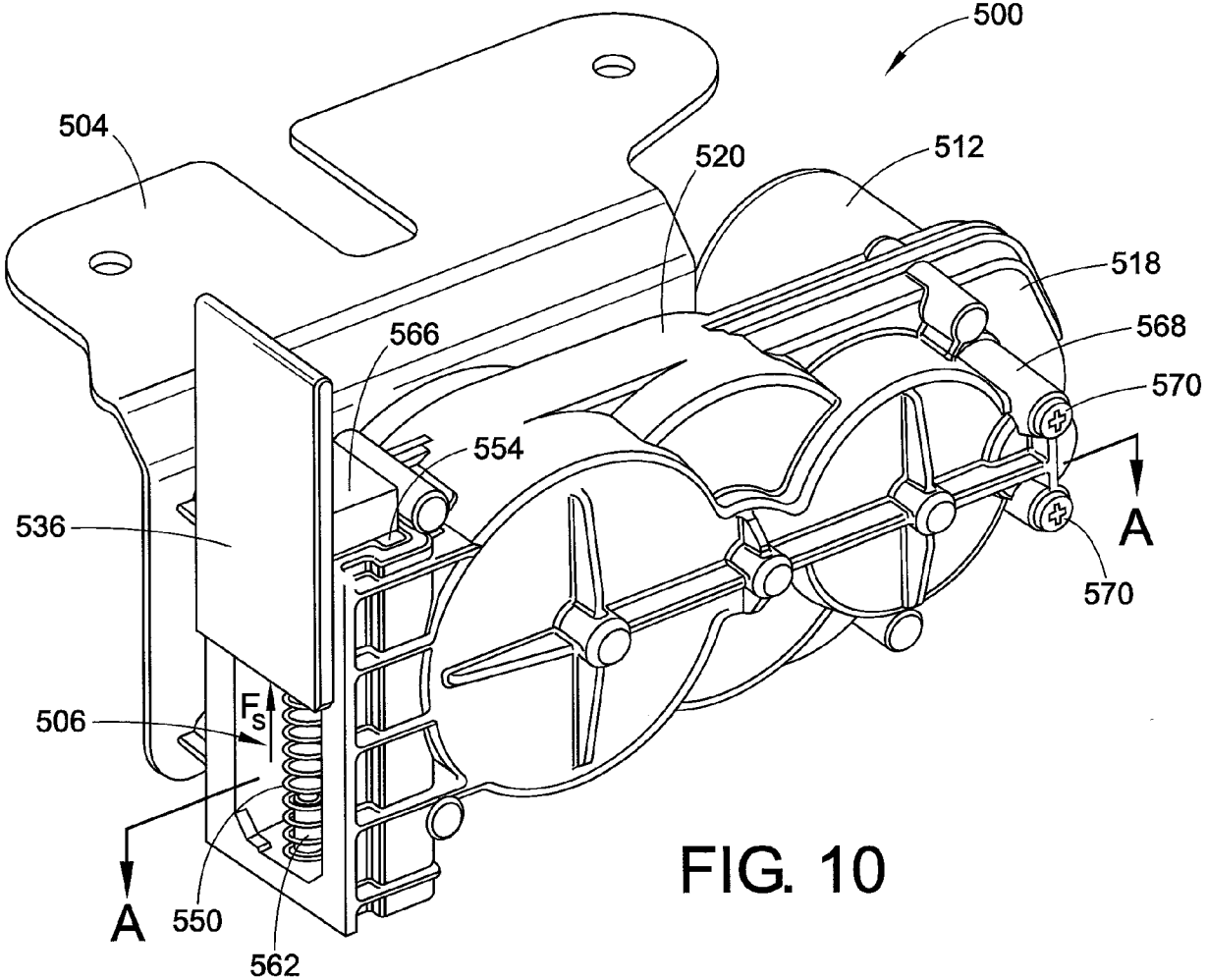
FIG. 10 is a perspective view of the electro-mechanical ejector of FIG. 9.
Figure 11:
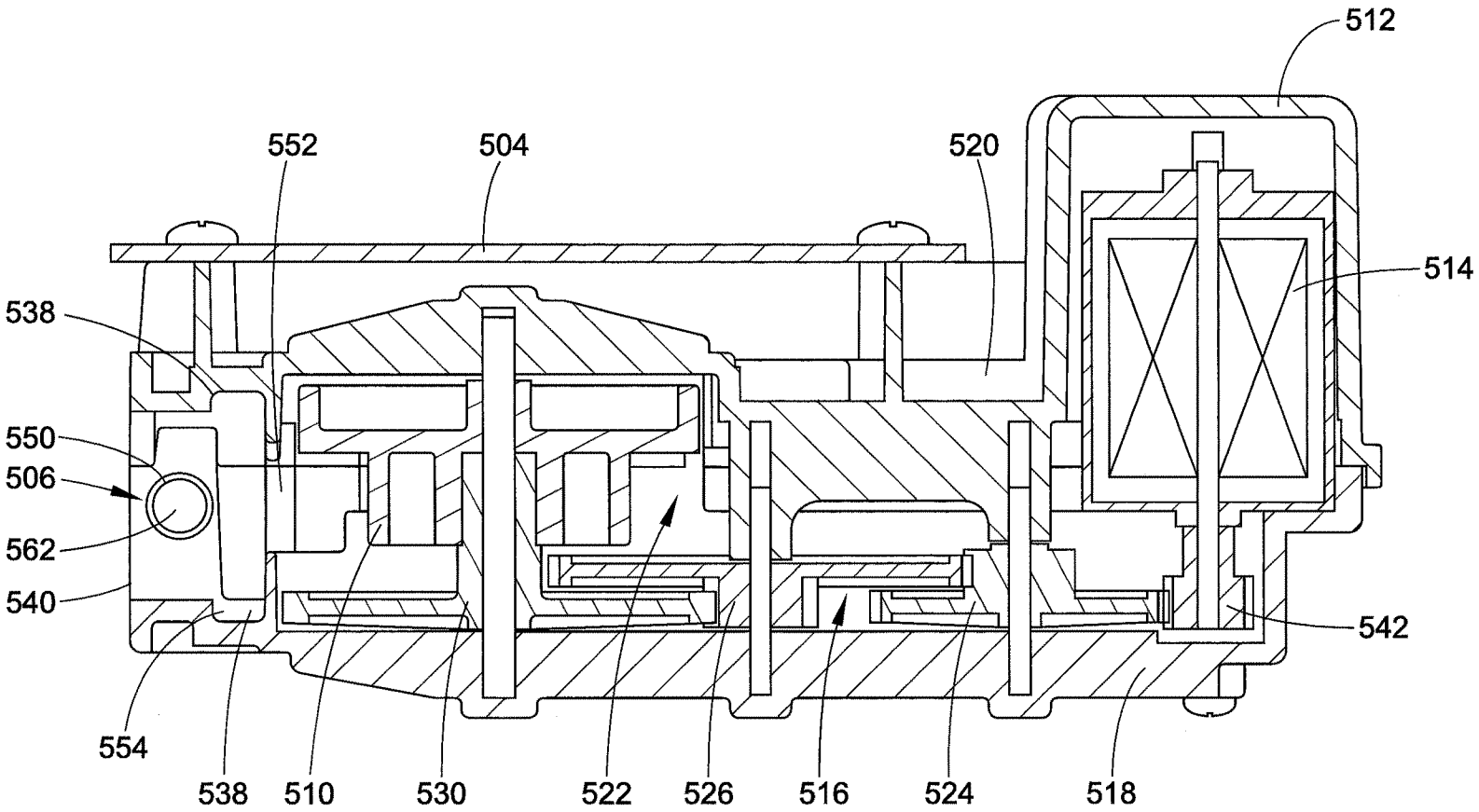
FIG. 11 is a sectional top view of the electro-mechanical ejector of FIG. 10.

With reference to FIGS. 9, 10, and 11, an alternative embodiment of an electromechanical ejector 500 that can be used herein is provided. In this embodiment, a cover plate 518 and a base plate 520 mate to define a first interior region 522. Cover plate or first housing 518 and base plate or second housing 520 also define a second interior region 506. The base plate 520 is mounted to a bracket 504 via suitable fasteners. The base plate 520 can further include a bore 508 to allow a rotary lock 510 to rotate at a predetermined distance around a central axis B that extends through the first interior region 522 along the center of bore 508. The base plate 520 can further include a generally cylindrical compartment 512 for accommodating a motor, such as a DC motor 514. The motor 514 drives a set of gears or gear train 516 within the interior region 522 which drives the rotary lock 510 so that it rotates around the central axis B. The set of gears 516, which can be compound gears, suitably reduce the rotary speed of the motor 514 to increase torque.

The set of gears includes a first gear 524 which is connected to a motor shaft on which is mounted a pinion gear 542. The first gear 524 drives a second gear 526 by way of a first toothed region 528 of the second gear 526. The second gear 526 drives a third gear 530. As can be appreciated, the third gear can include a smaller diameter toothed region (not visible), which engages a larger diameter toothed periphery of the second gear 526. The rotary lock 510 described above mounts to the third gear 530 and rotates at a predetermined distance from and about the central axis B.

Also located within the interior region 522 of the cover plate 518 and the base plate 520 is an electrically controlled relay 534 for providing power to the motor 514 via a power source external to the ejector 500, such as batteries or a power grid. Further, the relay 534 is controlled, as described below, by a controller. For each ejection cycle, the controller engages the relay 534, and hence the motor 514, for a predetermined period of time known to correspond to one full ejection cycle.

Mounted to the exterior of the mated cover plate 518 and base plate 520, and housed within the second interior region 506, the ejector 500 includes a spring loaded ejector plate 536. The second interior region 506 and slots 538 define a slotted channel wherein ejector plate can move up and down in the slots 538 of cover plate 518 and base plate 520. The ejector plate 536 can include an attachment feature 540. As shown in FIG. 9, the attachment feature 540 in this embodiment is illustrated as a T-beam 540. T-beam 540 can include a latch element 552, which protrudes in a direction perpendicular to the top surface 554 of T-beam 540. T-beam 540 fits within the slotted channel for mounting ejector plate 536 such that T-beam 540 is held in the second interior region 506. Also held in the second interior region 506 is a biasing member such as a compression spring 550. An upper end of the spring 550 contacts a bottom surface of T-beam 540 and a lower end of the spring rests on a knob 562, located at the bottom of interior region 506. Spring 550 normally remains in a compressed state such that ejector plate 536 is positioned under the surface of the track (not shown). Tooth 556 of rotary lock 510 engages latch 552 of T-beam 540 and prevents the ejector plate 536 from moving upward along slots 538 due to the upward force $F_s$ exerted by spring 550. To move ejector plate 536 up and down, the rotary lock 510 rotates downward in a counterclockwise direction, causing tooth 556 to disengage from latch 552 once tooth 556 passes opening 564 created by cover plate 518 and base plate 520. Rotary lock 510 prevents ejector plate 536 from moving up until the notch 560 reaches opening 564, at which point nothing is engaging latch 552. The upward force $F_s$ of spring 550 then causes ejector plate 536 to move explosively upward along slots 538. As the rotary lock 510 continues rotating, tooth 556 once again engages latch 552 when tooth 556 reaches opening 564, compresses spring 550, and returns ejector plate 536 to its position under the surface of the track, thus completing one full ejection cycle.

Ejector plate 536 can further include a pad 566 which is attached to a top surface 554 of the T-beam 540. Pad 556 can serve to dampen force Fs exerted by spring 550 when ejector plate 536 is released by rotary lock 510. Pad 556 can be made from any number of suitable materials, such as rubber and the like.

Referring now to FIG. 10, ejector 500 is shown as assembled for use within a dispenser system 300 as provided herein. The cover plate or first housing 518 is shown as mated to the base plate or rear housing 520 and to flange 504. It will be appreciated that any suitable method for attaching these components together may be used herein, such as screws, glue, or welding. A cylindrical compartment 512 of rear housing 520 can be seen as completely enclosing the motor 514 which can be attached to cover plate 518 by fasteners 568. For example, screws 570 can fixedly attach motor 514 to the ejector 500 via holes 568 in the cover plate 518. FIG. 10 also shows ejector plate 536 in its disengaged position within the second interior region 506. Compression spring 550 is shown in its fully extended position in the interior region 506, with force Fs being exerted on T-beam 540. The top surface of T-beam 540 can be seen just below pad 566.

Referring now to FIG. 11, ejector 500 is shown as assembled, with cross section taken along line A-A of FIG. 10. FIG. 11 illustrates assembled gear set or gear train 516 located within the first interior region 522 created by cover plate 518 and rear housing 520. Flange 504 can be seen as mounted to the rear housing 520. The first gear 524 of the set 516 is connected to the pinion gear 542 of the motor 514. The second gear 526 is connected to the third gear 530, and rotary lock 510 is shown as being mounted to the third gear 530. Latch 552 can be seen protruding from the back of T-beam 540, such that tooth 558 (not visible) can engage latch 552. FIG. 11 also shows T-beam 540 held in the second interior region 506 such that T-beam 540 can reciprocate in slots 538 of the slotted channel. Knob 562 is shown in its position at the bottom of interior surface 506 supporting spring 550.

Referring back to the dispensing system 300 of FIG. 5, ejector 500 as illustrated in FIGS. 9-11 can be used in place of ejector 322. To carry out vending or merchandising, each track 312 includes an ejector 500. During vending or merchandising, the ejector 500 coordinates with the compression trolley 316 of the track 312 to move the first packaged item 324 of the track 312 (i.e., the front most packaged item abutting the fixed stop plate 314) to a forward channel 326 extending vertically through all the dispensers 302 to an externally accessible cavity 328 of the base 304. It should be appreciated that the forward channel 326 is located in front of each dispenser 302 and the channels 326 are aligned so that merchandise or packaged items 324 can fall by gravity to the base 304. When the first packaged item 324 reaches the forward channel 326, the packaged item 324 falls through the forward channel 326 to the cavity 328, as illustrated. The forward channel 326 is defined by openings in the top and bottoms of each dispenser 302 which are sized to accommodate the packaged items. The cavity 328 is typically externally accessible via an opening 330 in the base 304. While not necessary, a hinged door 332 of the base 304 can cover the opening 330, as illustrated in FIG. 4. The hinged door 332 can be pivotally mounted and would be lifted to allow access to the cavity 328.

Referring back to the dispensing system 300 of FIG. 6, the vending or merchandising of the first packaged item 324 is illustrated in greater detail. Ejector 500 as illustrated in FIGS. 9-11 can be used in place of ejector 322. During vending or merchandising of the packaged item 324, the ejector 500 moves an ejector plate 536 linearly upwardly toward the surface 334 of the track 312 upon which the packaged item 324 rests. The ejector plate 536 moves linearly upward along a slotted channel defined by interior region 506 and slots 538. The attachment feature or T-beam 540 of the ejector plate 536 mounts within the slotted channel and permits the ejector plate 536 to move linearly upward and downward with respect to the cover plate 518 and base plate 520. Ejector plate 536 moves upward and downward via a biasing member or compression spring 550. Spring 550 is supported by knob 562 on the bottom of interior region 506 and exerts force Fs on a bottom surface of T-beam 540. Rotary lock 510 is mounted to the third gear 530 in the compound gear train 516. Rotary lock 510 includes a tooth 556 which engages the latch 552 of T-beam 540 and prevents ejector plate 536 from moving upward along the slotted channel in spite of the upward force Fs exerted by spring 550.

As the third gear 530 rotates the rotary lock 510, the tooth 556 of rotary lock 510 disengages from latch 552 once tooth 556 passes opening 564. The outside surface of the rotary lock 510 prevents ejector plate 536 from moving upward during rotation until a notch 560 in the rotary lock 510 meets the opening 564. With nothing engaging the ejector plate 536 at this time, the upward force Fs of spring 550 causes the ejector plate 536 to move rapidly upward through a slot in the surface 334 of the track 312 in a ballistic manner. Ejector plate 536 reaches its highest position when the spring 550 extends its full length as restricted by the height of interior region 506 such that a portion of the ejector plate 536 is located above the fixed stop plate 314. The slot is located adjacent to the fixed stop plate 314 and immediately beneath the packaged item 324 so that the first packaged item 324 is propelled above the fixed stop plate 314 from the ballistic ejecting force created by the ejector plate 536 acting on the bottom surface of the packaged item 324. When this happens, the force that is delivered to the first packaged item 324 by the trolley 316 through any intervening packaged items, delivers an ejecting force on a rear surface of the lifted first packaged item 324 causing it to move forward in the dispenser 302, as illustrated. The item 324 then falls through the forward channel 326.

After reaching its highest position above the fixed stop plate 314, the ejector plate 536 moves at once downwardly through the slot as the third gear 530 continues to rotate until the tooth 556 of rotary lock 510 re-engages with the latch 552 of T-beam 540. The continued rotation of rotary lock 510 and the engagement of tooth 556 with latch 552 re-compresses the spring 550 until the ejector plate 536 is fixed in a position below the surface 334, thereby completing one ejection cycle. With the first packaged item 324 and the ejector plate 536 no longer present, the next packaged item in line is forced to move up against the fixed stop plate 314 and is therefore in position to be ejected next.

Referring back to FIG. 4, when a vending or merchandising occurs, an audio and/or visual alert can be generated if certain criteria are met. For example, an audio and/or visual alert can be generated every time a packaged item is vended or merchandised. As another example, an audio and/or visual alert can be generated in response to the vending or merchandising of a predetermined number of packaged items, such as three, within a predetermined period of time, such as 30 seconds. This count can be specific to individual tracks 312, specific to individual dispensers 302, or common to the dispensing system 302. Further, the alerts can, for example, be presented by an audio and/or visual device 336. The audio and/or visual device 336 can be specific to the dispenser 312, such as a speaker or the illustrated light source, or common to the dispenser system 300, such as a public address (PA) system.

Figure 12:
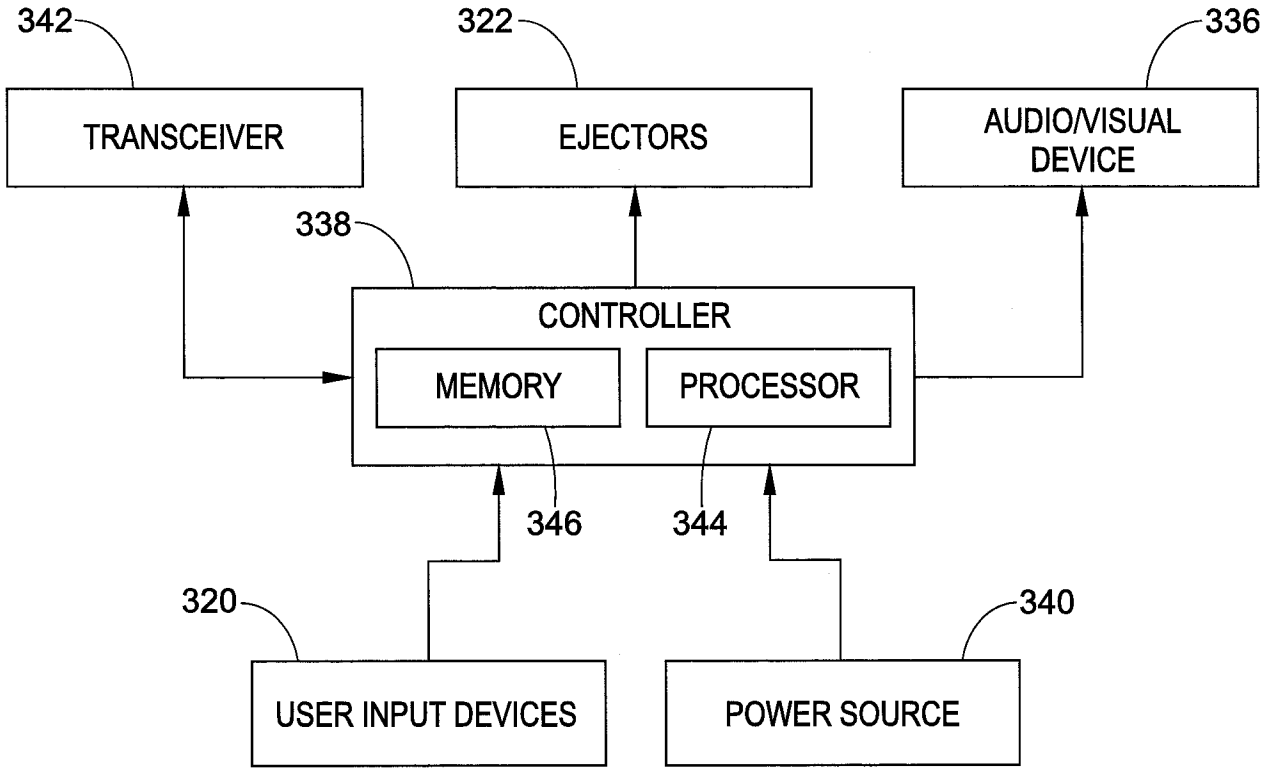
FIG. 12 is a block diagram of an electrical system of a dispenser of FIG. 4.
Figure 13:
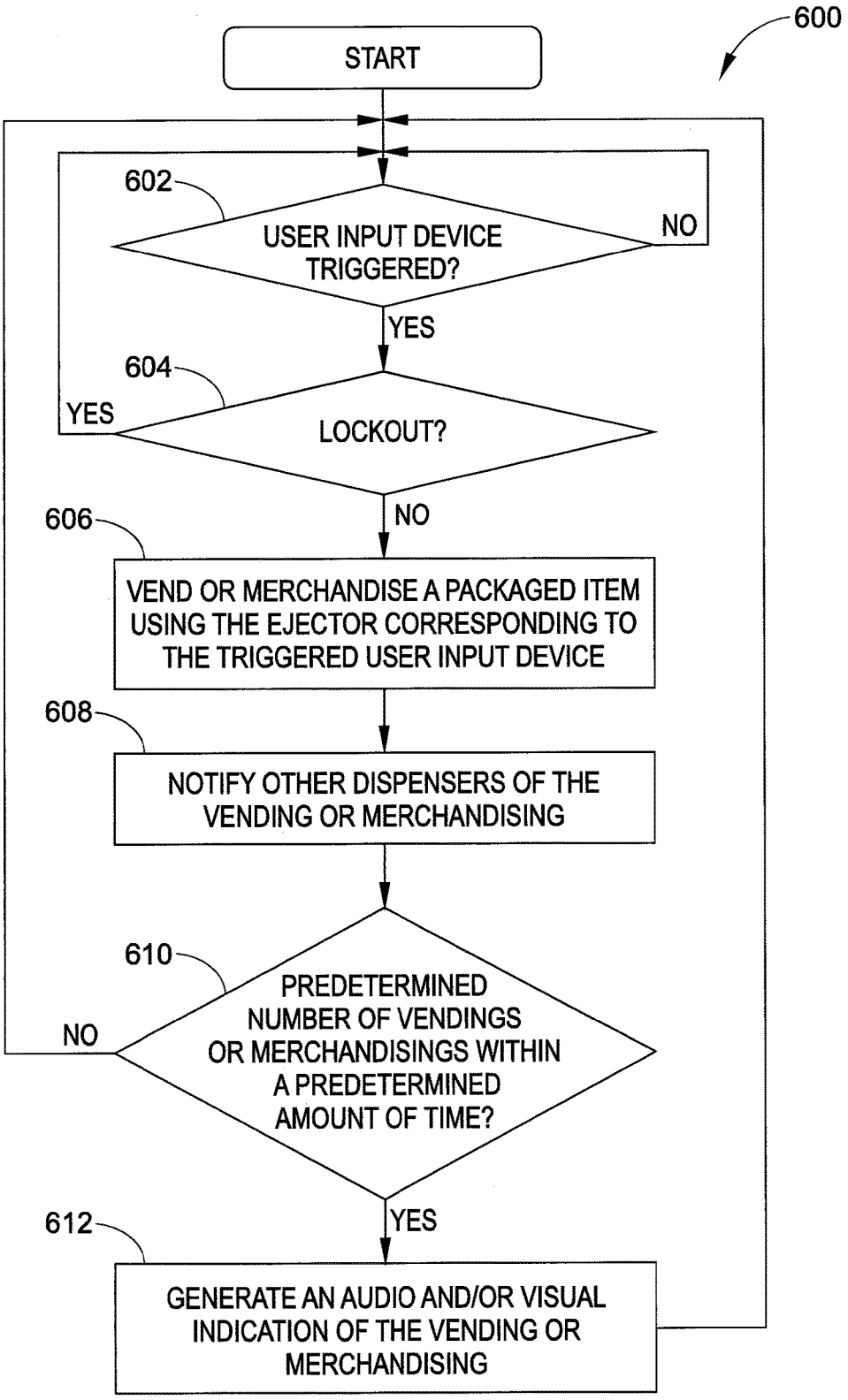
FIG. 13 is a flow chart describing operation of a controller of the electrical system of FIG. 12.

With reference to FIG. 12, each of the dispensers 302 typically includes a controller 338 arranged within the enclosure 306. The controller 338 receives power from a power source 340 and implements a process 600 described in FIG. 13. The power source 340 can be located within the dispenser 302 or external to the dispenser 302, such as within the base 304. Examples of a suitable power source 340 include batteries and a power grid. During operation of the dispenser 302, the controller 338 monitors 602 the user input devices 320 of the dispenser for a triggering occurrence.

Upon detecting the triggering of a user input device 320, the controller 338 determines 604 whether a lockout is in place. A discussed above, a lockout can last a predetermined period of time, such as 7-10 seconds, and can occur if certain criteria are met. For example, a lockout can occur in response to the vending or merchandising of a packaged item by only the corresponding track 312, by only tracks 312 of the corresponding dispenser 302, or by the vending or merchandising by any track 312 of any of the dispensers 302 in the system 300. As another example, a lockout can occur in response to the vending or merchandising of a predetermined number of packaged items, such as three, within a predetermined period of time, such as 30 seconds. This vending or merchandising can be limited to only the corresponding track 312, only tracks 312 of the corresponding dispenser 302, or any track 312 of any of the dispensers 302 in the system 300.

If a lockout is underway, the controller 338 goes back to monitoring the user input devices 320 of the dispenser 302 for a triggering. Otherwise, the controller 338 controls the ejector 322 to vend or merchandise (i.e., dispense) 606 the packaged item corresponding to the triggered user input device 320. Further, in some embodiments, other dispensers 302 are notified 608 of the vending or merchandising by a transceiver 342. These other dispensers 302 can then act upon these notices, for example, by using them to determine whether lockout criteria are met. Communications can, for example, be performed over a wired or wireless communication network. Further, communications can be sent direct to each other dispenser 302, broadcast to all the dispensers 302, or provided to a central controller for distribution to the other dispensers 302. Such information can also be sent via wireless or wired communications to a store central security location.

A determination is next made 610 as to whether to generate an audio and/or visual alert of the vending or merchandising. Typically, this determination includes determining whether a predetermined number of packaged items, such as three, have been dispensed within a predetermined period of time, such as 30 seconds. This count can be specific to individual tracks 312, specific to individual dispensers 302, or common to the dispensing system 302. Alternatively, an audio and/or visual alert can be generated for every vending or merchandising. If an audio and/or visual alert should be generated, an alert is generated 612 using the audio and/or visual device 336. The alert can, for example, be an audio beep, a blink of a light source, or message over a public address (PA) system. The controller 338 next goes back to monitoring the user input devices 320 of the dispenser 302 for a triggering.

The controller 338 is suitably a microcontroller comprised of a processor 344 and a memory 346. The memory 346 includes processor executable instructions embodying the process 600 described in FIG. 13, which are executed by the processor 344 to perform the functions described in FIG. 13. Notwithstanding that the controller 338 suitably employs the processor 344 to carry out the functions described in FIG. 13 the controller 338 can perform these functions without the use of the processor 344 by using analog and/or digital circuitry.

The instant disclosure has been described with reference to the preferred embodiments. Obviously, modifications and alterations will occur to others upon reading and understanding the preceding detailed description. It is intended that the instant disclosure be construed as including all such modifications and alterations insofar as they come within the scope of the appended claims or the equivalents thereof.

The invention claimed is:

1. A merchandise dispensing apparatus for deterring theft, comprising:

a housing comprising a plurality of walls defining an interior space within the housing;

at least one merchandise support module mounted in the housing, the at least one module comprising an electromechanical ejector mechanism located adjacent a front end of the at least one module, the ejector mechanism including:

an ejector housing, an electrical motor mounted to the ejector housing and including an output shaft, an ejector plate mounted to the ejector housing and movably mounted in relation to the ejector housing and having a retracted position and an extended position, a biasing member mounted to the ejector housing and adapted to directly contact the ejector plate and bias the ejector plate linearly into its extended position, the biasing member having a compressed state corresponding to the retracted position of the ejector plate and an expanded state corresponding to the extended position of the ejector plate, a gear train located within the ejector housing and connecting the output shaft of the motor to the ejector plate, a relay for selectively providing electrical power to the motor, and a user input member for selectively operating the motor via the relay, wherein the ejector plate further comprises a latch member located in the ejector housing for retaining the ejector plate in the retracted position against the bias of the biasing member.

2. The apparatus of claim 1 wherein the biasing member comprises a spring which urges the ejector plate linearly upwardly into its extended position.

3. The apparatus of claim 1 wherein the user input member comprises a button.

4. The apparatus of claim 1 wherein the gear train comprises at least two speed reduction gears.

5. The apparatus of claim 4 wherein the at least two gears are compound gears each including a larger diameter toothed peripheral section and a smaller diameter toothed peripheral section.

6. The apparatus of claim 4 wherein the gear train comprises three gears.

7. The apparatus of claim 6 further comprising a rotary lock mounted to the third gear and engaging the ejector plate.

8. The apparatus of claim 7 further comprising a tooth disposed on the rotary lock and engaging the latch member of the ejector plate.

9. The apparatus of claim 1 where a plurality of spaced modules are arranged in a side by side manner in the housing.

10. The apparatus of claim 9 where a plurality of spaced user input devices are accessible to customers, each input device being connected to a respective module.

* * * * *